US011286816B2

(12) United States Patent
Aumann et al.

(10) Patent No.: US 11,286,816 B2
(45) Date of Patent: Mar. 29, 2022

(54) ORC DEVICE FOR COOLING A PROCESS FLUID

(71) Applicant: Orcan Energy AG, Munich (DE)

(72) Inventors: Richard Aumann, Munich (DE); Andreas Schuster, Tussenhausen (DE); Markus Lintl, Munich (DE); Roy Langer, Langenau (DE); Martin Santa-Maria, Munich (DE)

(73) Assignee: ORCAN ENERGY AG, Munich (DE)

( * ) Notice: Subject to any disclaimer, the term of this patent is extended or adjusted under 35 U.S.C. 154(b) by 0 days.

(21) Appl. No.: 16/641,896

(22) PCT Filed: Jul. 27, 2018

(86) PCT No.: PCT/EP2018/070373
§ 371 (c)(1),
(2) Date: Feb. 25, 2020

(87) PCT Pub. No.: WO2019/038022
PCT Pub. Date: Feb. 28, 2019

(65) Prior Publication Data

US 2021/0199026 A1 Jul. 1, 2021

(30) Foreign Application Priority Data

Aug. 25, 2017 (EP) ..... 17187936

(51) Int. Cl.
*F01K 25/10* (2006.01)
*F01K 13/02* (2006.01)
*F01K 9/00* (2006.01)

(52) U.S. Cl.
CPC ..... *F01K 25/10* (2013.01); *F01K 13/02* (2013.01); *F01K 9/003* (2013.01)

(58) Field of Classification Search
CPC ..... F01K 25/10; F01K 13/02; F01K 9/003; F01K 25/08; F01K 13/00; F22B 1/02
(Continued)

(56) References Cited

U.S. PATENT DOCUMENTS 4,374,467 A * 2/1983 Briley ..... F24D 11/0221 62/238.1
4,753,079 A 6/1988 Hiroyuki
(Continued)

FOREIGN PATENT DOCUMENTS

DE 102012217339 A1 3/2014
EP 1925806 A2 5/2008
(Continued)

OTHER PUBLICATIONS

International Search Report and Written Opinion for corresponding European PCT Application No. 2018/070373, dated Oct. 19, 2018, 12 pages.
(Continued)

*Primary Examiner* — Hoang M Nguyen
(74) *Attorney, Agent, or Firm* — Moore & Van Allen PLLC; Henry B. Ward, III

(57) ABSTRACT

The invention refers to a system for cooling a process fluid of a heat-producing apparatus, comprising: an outlet of the heat-producing apparatus, the outlet being provided for discharging process fluid to be cooled from the heat-producing apparatus; an inlet of the heat-producing apparatus, the inlet being provided for supplying cooled process fluid to the heat-producing apparatus; and a thermodynamic cycle device, in particular an ORC device, the thermodynamic cycle device comprising an evaporator having an inlet for supplying the process fluid to be cooled from the outlet of the heat-producing apparatus and having an outlet for discharging the cooled process fluid to the inlet of the heat-
(Continued)

producing apparatus, the evaporator being adapted to evaporate a working medium of the thermodynamic cycle device by means of heat from the process fluid; an expansion machine for expanding the evaporated working medium and for producing mechanical and/or electrical energy; a condenser for liquefying the expanded working medium, in particular an air-cooled condenser; and a pump for pumping the liquefied working medium to the evaporator.

17 Claims, 7 Drawing Sheets

(58) Field of Classification Search
USPC ..... 60/651, 671
See application file for complete search history.

(56) References Cited

U.S. PATENT DOCUMENTS

| | | | | |
|---|---|---|---|---|
| 7,062,913 | B2 * | 6/2006 | Christensen | F02C 1/05 60/651 |
| 8,528,333 | B2 * | 9/2013 | Juchymenko | F01K 23/02 60/618 |
| 8,881,523 | B2 | 11/2014 | Kasuya | |
| 2003/0000213 | A1 | 1/2003 | Christensen et al. | |
| 2006/0144047 | A1 * | 7/2006 | Inaba | F25B 6/04 60/618 |
| 2013/0247570 | A1 * | 9/2013 | Lehar | F22B 35/086 60/643 |
| 2013/0299123 | A1 * | 11/2013 | Matula | F25D 17/00 165/45 |
| 2014/0007575 | A1 | 1/2014 | Ernst et al. | |
| 2014/0033713 | A1 | 2/2014 | Juchymenko | |

FOREIGN PATENT DOCUMENTS

| | | | |
|---|---|---|---|
| EP | 2320058 | A1 | 5/2011 |
| JP | S62206302 | A | 9/1987 |
| JP | 2004098951 | A | 4/2004 |
| JP | 2008128254 | A | 6/2008 |
| JP | 2009167994 | A | 7/2009 |
| JP | 2009167995 | A | 7/2009 |
| JP | 2014129798 | A | 7/2014 |

OTHER PUBLICATIONS

European Search Report for corresponding European Patent Application No. 17187936.4, dated Apr. 5, 2018, 9 pages.
Office Action issued by the Japanese Patent Office for Japanese Patent Application No. 2020-531809, dated Mar. 3, 2021.
Examination Report issued by the Indian Patent Office for Indian Patent Application No. 202047012424, dated May 18, 2021.
Communication pursuant to Article 94 (3) EPC dated Sep. 13, 2021, for related EP Application No. 17187936.4, 13 pages.
Office Action issued by the Japanese Patent Office for Japanese Patent Application No. 2020-531809, dated Sep. 14, 2021.
First Office Action issued by the Chinese Patent Office for Chinese Patent Application No. 201880069574.0, dated Dec. 14, 2021.
Search Report issued by the Chinese Patent Office for Chinese Patent Application No. 201880069574.0, dated Dec. 14, 2021.
Office Action issued by the European Patent Office for European Patent Application No. 17 187 936.4, dated Jan. 28, 2022.

* cited by examiner

ORC DEVICE FOR COOLING A PROCESS FLUID

FIELD OF THE INVENTION

The invention refers to a system for cooling a process fluid of a heat-producing apparatus.

STATE OF THE ART

Currently there are numerous applications in industry (e.g. cooling of air compressors, food industry, chemical industry), in power generation (e.g. cooling of motor cooling water in stationary motors, transformers) or in traffic (internal combustion engines, e.g. trucks), where e.g. electrical (or mechanical) energy is used to drive a cooler, e.g. an air cooler. The medium to be cooled is usually guided into a heat exchanger through which ambient air flows. The air flow is generated by means of electrically or mechanically driven fans, for example. The medium to be cooled (hereinafter referred to as process fluid) releases the energy to the ambient air and returns to the process cooled. The disadvantage is that electrical or mechanical energy is used to extract thermal energy from the process.

DESCRIPTION OF THE INVENTION

The object of the invention is to avoid or at least mitigate the disadvantages mentioned.

The invention describes the solution of the above-mentioned problem by partially converting the heat extracted from the medium into mechanical and/or electrical energy by means of a thermodynamic cycle device.

The solution according to the invention is defined by a device comprising the features according to claim 1.

The invention thus discloses a system for cooling a process fluid of a heat-producing apparatus, comprising: an outlet of the heat-producing apparatus, the outlet being adapted for discharging process fluid to be cooled from the heat-producing apparatus; an inlet of the heat-producing apparatus, the inlet being adapted for supplying cooled process fluid to the heat-producing apparatus; and a thermodynamic cycle device, in particular an ORC device, the thermodynamic cycle device comprising an evaporator having an inlet for supplying the process fluid to be cooled from the outlet of the heat-producing apparatus and having an outlet for discharging the cooled process fluid to the inlet of the heat-producing apparatus, wherein the evaporator is adapted to evaporate a working medium of the thermodynamic cycle apparatus by means of heat from the process fluid; an expansion machine for expanding the evaporated working medium and for generating mechanical and/or electrical energy; a condenser for liquefying the expanded working medium, in particular an air-cooled condenser; and a pump for pumping the liquefied working medium to the evaporator. The mechanical and/or electrical energy obtained can be used to operate the condenser, especially to drive a fan of an air-cooled condenser.

A further development of the system according to the invention is that a cooler, in particular an air cooler, may be provided for cooling at least part of the process fluid to be cooled. In this way, emergency operation can be guaranteed in the event of failure of the thermodynamic cycle device.

Another further development consists in the fact that a branch is provided, which, with respect to a flow direction of the process fluid, is provided downstream of the outlet of the heat-producing apparatus and upstream of the inlet of the heat-producing apparatus for dividing the process fluid to be cooled into a first and a second partial flow of the process fluid, wherein the branch optionally comprises a valve; and a junction provided downstream of the branch and upstream of the inlet of the heat-producing apparatus with respect to a flow direction of the process fluid for merging the first and second partial flows of the process fluid.

According to this further development, the flow of the process fluid can, for example, be divided into two partial flows, wherein one partial flow is guided through the evaporator and the other partial flow through the cooler. It is also possible, however, not to guide the flow of the process fluid through the evaporator and/or cooler at all or only partially, for example if the cooling of the process fluid would otherwise be too strong for the heat-producing apparatus. For this purpose, the branch or a further branch and the junction or a further junction may be connected via a connecting line in such a way that the process fluid exiting from the outlet of the heat-producing apparatus is at least partially guided directly back to the inlet, whereby the mass flow through the connecting line can be adjusted via the or a further valve.

This can be further developed to the effect that the branch is provided downstream of the outlet and upstream of the inlet, with respect to a flow direction of the process fluid, for dividing the process fluid to be cooled into the first and the second partial flow of the process fluid, the branch optionally comprising a valve. This makes it possible to direct all or part of the process fluid to be cooled before the evaporator directly to the cooler.

The junction may be provided downstream of the outlet with respect to a flow direction of the process fluid and upstream of the inlet for merging the second partial flow of the process fluid cooled by the condenser and the first partial flow of the process fluid cooled by the evaporator; wherein the junction is designed for feeding the first partial flow to the evaporator and for feeding the second partial flow to the condenser. Thus, with respect to the flow of the process fluid, a parallel connection of the components (evaporator, cooler), which extract heat from the process fluid, is realized.

In another further development, the cooler may be located downstream of the outlet and upstream of the inlet with respect to a flow direction of the process fluid for further cooling of the process fluid cooled by the evaporator. This represents a series connection of the components (evaporator, cooler) that extract heat from the process fluid.

According to another further development, the cooler can form a structural unit with the condenser or be provided separately from the condenser. If the cooler is designed in one structural unit with the condenser, for example, a common fan can be provided for air cooling. If the cooler is designed separately from the condenser, the cooling capacity of these components can be controlled independently.

Another further development is that the system may also include a control device to control the heat input to the cooler, which in particular makes it possible to achieve a set temperature of the process fluid returned to the inlet of the heat-producing apparatus.

According to another further development, an intermediate circuit with a heat transfer fluid may be provided for the thermal connection of the condenser and the cooler, wherein the condenser is provided for transferring heat from the expanded working medium to the heat transfer fluid and wherein the cooler is provided for cooling the heat transfer fluid.

This can be further developed in such a way that useful heat can be dissipated from a branch of the heat transfer fluid flowing from the condenser to the cooler to a useful heat means.

A (chemical) composition of the heat transfer fluid can be identical to a composition of the process fluid.

The system according to the invention or one of its further developments may further comprise a further heat exchanger which is provided downstream of the evaporator with respect to a flow direction of the process fluid for transferring heat from the process fluid cooled by the evaporator to a heat transfer fluid.

This can be further developed to the effect that the system also includes a valve to control the mass flow of the heat transfer fluid through the additional heat exchanger. Thus, process fluid precooled in the evaporator is guided to another heat exchanger where it can be cooled to a target temperature. A temperature measuring device may also be provided to measure the temperature of the process fluid downstream of the other heat exchanger, in which case the valve can then be controlled depending on the measured temperature.

The system according to the invention or a further development thereof may further comprise: a further evaporator between the outlet and the inlet for further evaporation of working medium by means of heat from the process fluid; a throttle valve for lowering the pressure of the working medium; and a liquid jet pump and/or a vapor jet pump between the further evaporator and the condenser for lowering the pressure in the further evaporator, wherein in particular a part of the liquefied working medium or a part of the evaporated working medium serves as a driving jet. This is realized by a 3-stage cooling of the process fluid, which is described in more detail in the embodiments.

The further developments with a cooler may be designed so that the outlet of the evaporator is connected to an inlet of the cooler, an outlet of the cooler is connected to an inlet of the condenser and an outlet of the condenser is connected to the inlet of the heat-producing apparatus, so that in operation the process fluid is guided from the evaporator through the cooler for further cooling, then subsequently guided through the condenser as a heat-absorbing medium and again subsequently guided to the inlet of the heat-producing apparatus. The cooler is therefore operated independently of the thermodynamic cycle and represents a possibility for emergency operation of the system (in the sense of emergency cooling of the process fluid).

The above-mentioned further developments can be used individually or combined with each other as required.

Further features and exemplary embodiments as well as advantages of the present invention are explained in more detail below on the basis of the drawings. It is understood that the embodiments do not exhaust the scope of the present invention. It is also understood that some or all of the features described below may be combined in other ways.

DRAWINGS

Identical reference numerals in the drawings refer to identical or corresponding components.

EMBODIMENTS

In numerous applications of air coolers (see section: State of the art) a medium is cooled with temperatures >50° C. This temperature level is sufficient to operate a thermodynamic cycle, e.g. an Organic Rankine Cycle (ORC) process. In addition to the cooling function, useful mechanical and/or electrical energy can be provided. This energy can, for example, drive an air cooler or be used for other purposes (operation of consumers close to the process, pumps, energy storage systems, etc.).

The thermodynamic cycle thus replaces the air cooler originally used for the respective application, which is why in the case of an Organic Rankine Cycle process, for example, one can speak of an ORC cooler for the application.

Specific preferred requirements for the ORC cooler:

- The cooling capacity should be guaranteed even if the ORC circuit fails.
- In some applications, no surplus electricity should be generated because direct feed-in may increase the technical and legal complexity disproportionately. In such a case, therefore, no connection to the power supply system is required.
- It should be as maintenance-free as possible, or there should be no increase in maintenance effort compared to conventional coolers.
- If necessary, a temperature level of the main process/the process to be cooled should be maintained, e.g. a temperature of the returned process fluid should be achieved or fallen below. By adding at least one more heat exchangers, a further temperature difference between the working medium or also the process fluid and the cooling fluid of a cooler (e.g. ambient air or cooling water) is present, so that the target temperature of the process to be cooled cannot be maintained. The problem of the additional temperature difference is solved by the below mentioned interconnections.
- A modularity of the system is preferred in order to be able to provide higher cooling capacities if required.
- There should be no impact on the existing control system of the main process.

In general, the ORC cooler can be used for all processes in which the fluid to be cooled can be returned to the process with a sufficiently large temperature gap to the ambient temperature (e.g. with a temperature above 40° C.).

Example applications for processes to be cooled (not complete):

- Engines (train, truck, construction machinery, crane, marine)

Air compressors

Industrial processes (automotive, chemical, printing, electrical and electronic, glass, rubber, plastic, laser, food, pharmaceutical, textile, environment, packaging, . . . )

Transformer stations

Data center (server cooling)

Detailed Description in Connection with the Drawings

Variant 1—Basic Interconnection

Figure 1:
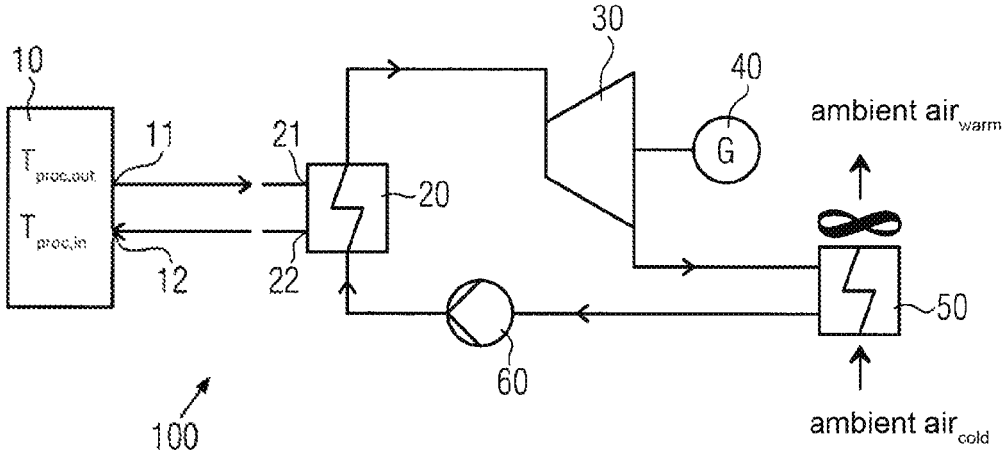
FIG. 1 shows a first embodiment (variant 1) of the device according to the invention.

FIG. 1 shows a first embodiment 100 of the thermodynamic cycle device according to the invention.

The system 100 for cooling a process fluid (e.g. water) of a heat-producing apparatus 10, comprising: an outlet 11 of the heat-producing apparatus, the outlet 11 being provided for discharging process fluid to be cooled from the heat-producing apparatus 10; an inlet 12 of the heat-producing apparatus 10, the inlet 12 being provided for supplying cooled process fluid to the heat-producing apparatus 10; and a thermodynamic cycle device, in particular an ORC device, the thermodynamic cycle device comprising an evaporator 20 having an inlet 21 for supplying the process fluid to be cooled from the outlet 11 of the heat-producing apparatus 10 and having an outlet 22 for discharging the cooled process fluid to the inlet 12 of the heat-producing apparatus 10, wherein the evaporator 20 is adapted to evaporate a working medium of the thermodynamic cycle device by means of heat from the process fluid; an expansion machine 30 for expanding the evaporated working medium and for generating mechanical and/or electrical energy, for example by means of an electrical generator 40; a condenser 50 for liquefying the expanded working medium, in particular an air-cooled condenser 50; and a pump 60 for pumping the liquefied working medium to the evaporator.

The implementation of the invention in its simplest embodiment according to FIG. 1 is as follows. In evaporator 20, the hot process fluid with the process temperature $T_{proc,out}$ is cooled to the target temperature $T_{proc,in}$, while the absorbed heat is used to evaporate the working fluid in the ORC circuit. The live steam generated in this way is expanded in the expansion machine 30, which can be used to drive a generator 40, for example. The exhaust vapor is liquefied in the condenser 50 and is then available in liquid form at the pump 60. The pump 60 then returns the working medium to the desired pressure. The device in FIG. 1 replaces the previously used conventional air cooler of the process 10 and generates additional useful power. As explained above, however, the target temperature $T_{proc,in}$ cannot be as low as without the ORC circuit due to the additional circuit of the working medium. Furthermore, in this first embodiment, the system is not capable of emergency operation. This means that if the ORC system fails, the temperature $T_{proc,out}$ cannot be lowered, it cannot be cooled.

Variant 2A—Parallel Interconnection

Figure 2A:
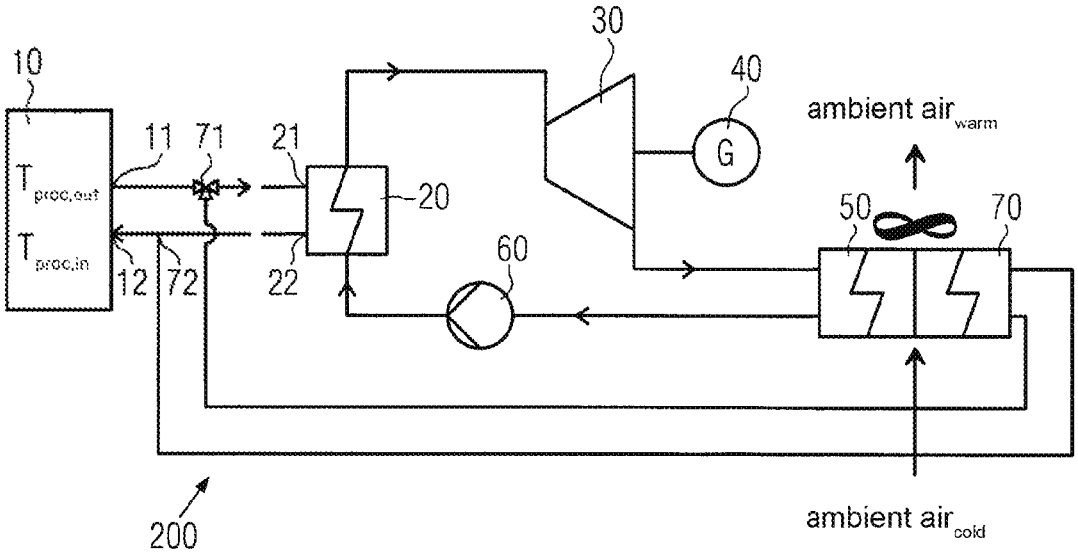
FIG. 2 shows a second embodiment (variant 2A) of the device according to the invention.

FIG. 2A shows a second embodiment 200 of the device according to the invention.

In this second embodiment 200 of the system according to the invention, the cooler 70 (here an air cooler 70) is additionally provided for cooling at least part of the process fluid to be cooled. The system 200 comprises a branch 71, which is exemplarily provided downstream of the outlet 11 and upstream of the inlet 21 with respect to a flow direction of the process fluid, for dividing the process fluid to be cooled into a first and a second partial flow of the process fluid, wherein the branch 71 in this example comprises a valve V. The system 200 further comprises a junction 72, which is provided downstream of the outlet 22 and upstream of the inlet 12 with respect to a flow direction of the process fluid, for merging the second partial flow of the process fluid cooled by the condenser 70 and the first partial flow of the process fluid cooled by the evaporator 20; wherein the branch 71 is adapted to supply the first partial flow to the evaporator 20 and to supply the second partial flow to the condenser 70. Thus, with respect to the flow of the process fluid, a parallel interconnection of the components (evaporator 20, cooler 70), which extract heat from the process fluid, is realized. In this case, the cooler 70 is designed in one structural unit with the condenser 50, and a common fan can be provided for air cooling.

The interconnection as shown in FIG. 2A thus solves the problem of the emergency operation characteristic. The bypass option (via valve V) of the ORC circuit ensures cooling in the event of failure of the ORC circuit. The target temperature $T_{proc,in}$ can be achieved by bypassing the ORC circuit with a partial flow, cooling it directly in the air cooler (e.g.: V-cooler, table cooler) and then mixing it again with the partial flow from the ORC evaporator 20. The electricity produced by the generator 40 in the ORC circuit can be used directly to supply the air cooler 70 (or the combination of evaporator 50 and air cooler 70), thus significantly reducing its electricity costs and increasing the efficiency of the cooler 70 (evaporator 50). In addition, with this connection it is possible to always reach the target temperature $T_{proc,in}$.

Figure 2B:
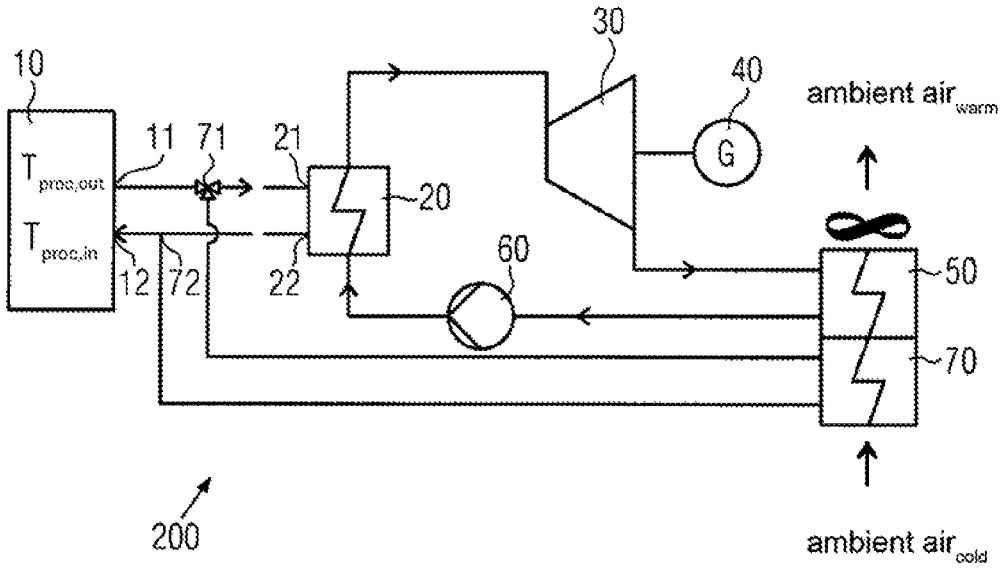

FIG. 2B represents a variation of the embodiment according to FIG. 2A in that the flow of ambient air does not pass through the condenser 50 and the cooler 70 in parallel as in FIG. 2A, but successively first through the cooler 70 and then through the condenser 50.

This has the advantage of a compact design, with the lowest air temperature at the cooler 70, so that a low temperature of the process fluid can be achieved, while cooling of the working fluid in the condenser 50 is less effective.

Figure 2C:
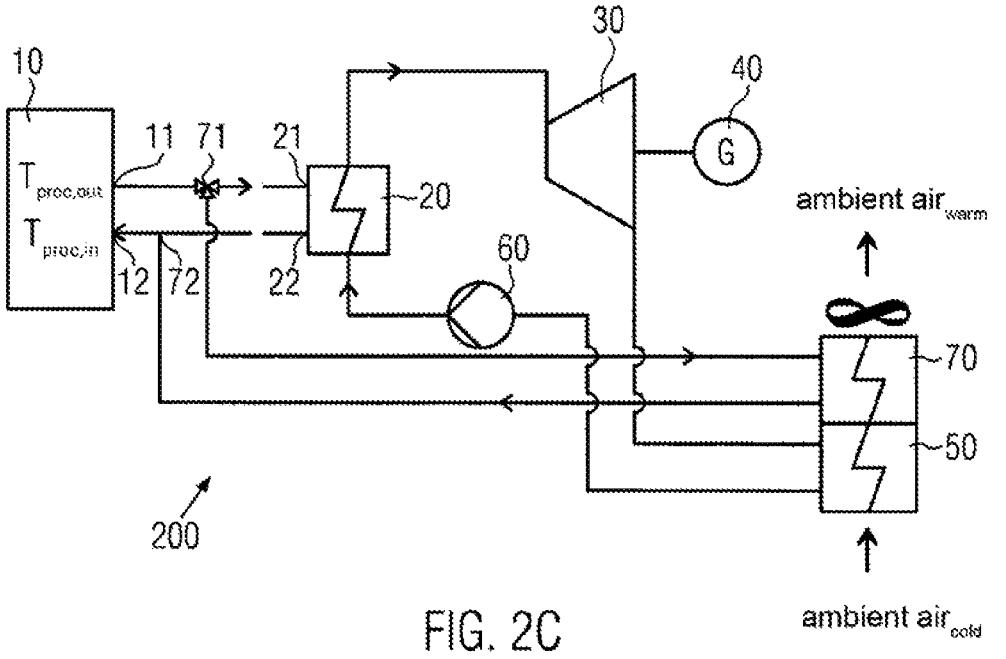

FIG. 2C represents an alternative to the modification according to FIG. 2B. Here, the sequence of cooler 70 and evaporator 50 is reversed with respect to the air flow, so that the ambient air first flows through evaporator 50 and then through cooler 70. As a result, the lowest air temperature is present at the condenser 50, so that with the ORC circuit a higher power generation via generator 40 is possible.

In the modifications according to FIGS. 2B and 2C the emergency operation capability described in relation to FIG. 2A is maintained.

Variant 2B—Serial Interconnection

Figure 3:
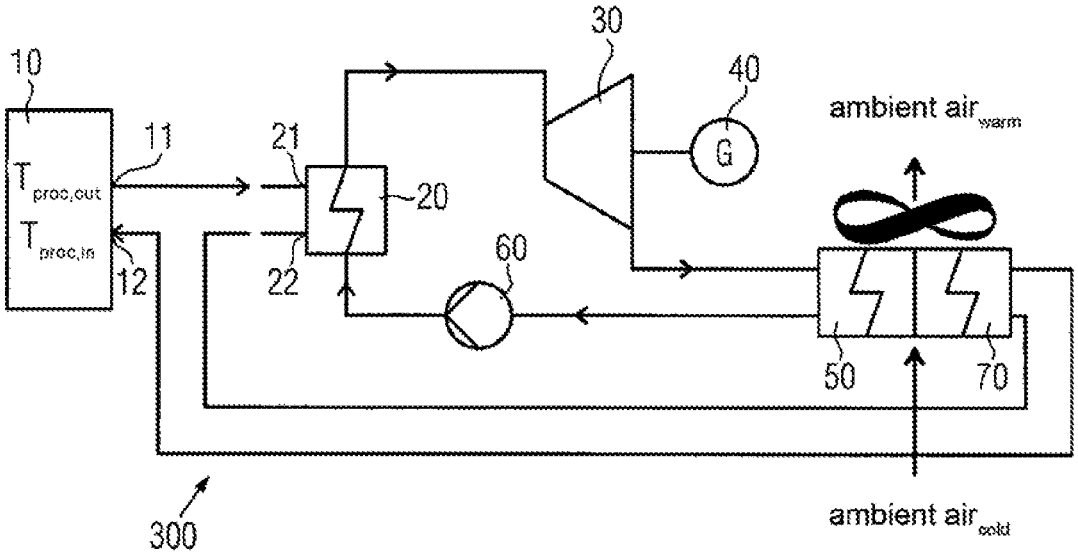
FIG. 3 shows a third embodiment (variant 2B) of the device according to the invention.

FIG. 3 shows a third embodiment 300 of the device according to the invention.

In the third embodiment, the cooler 70 is located downstream of the outlet 22 of the evaporator 20 and upstream of the inlet 12 of the heat-producing apparatus 10 with respect to a flow direction of the process fluid for further cooling of the process fluid cooled by the evaporator. This realizes a series connection of the components (evaporator 20, cooler 70), which extract heat from the process fluid. In a modified embodiment, a valve can be provided (similar to the embodiment shown in FIG. 2) which only guides a part of the process fluid over the cooler 70.

Figure 4:
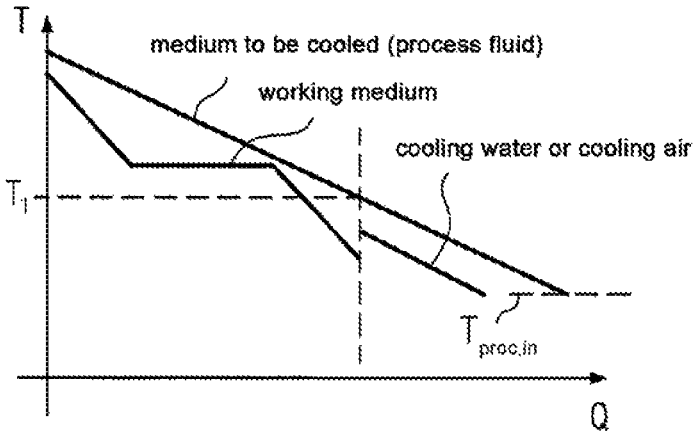
FIG. 4 shows a temperature-heat flow diagram (T-Q diagram)

The process fluid/water return from the ORC evaporator 20 is sent through the air cooler 70 to allow further cooling. In a further development, the heat input to the air cooler 70 can be controlled by an intelligent control (e.g. with the aid of the aforementioned valve) in order not to cool down any further than necessary. The aim is to achieve the required $T_{proc,in}$ without consuming electricity. This is shown in the temperature-heat flow diagram according to FIG. 4 (T-Q diagram).

If the cooling T1 achievable by the ORC cycle is above a required limit, a lower temperature $T_{proz,on}$ can be achieved by additional cooling by water or air in the downstream cooler.

Variant 2C—Independent Interconnection

Figure 5:
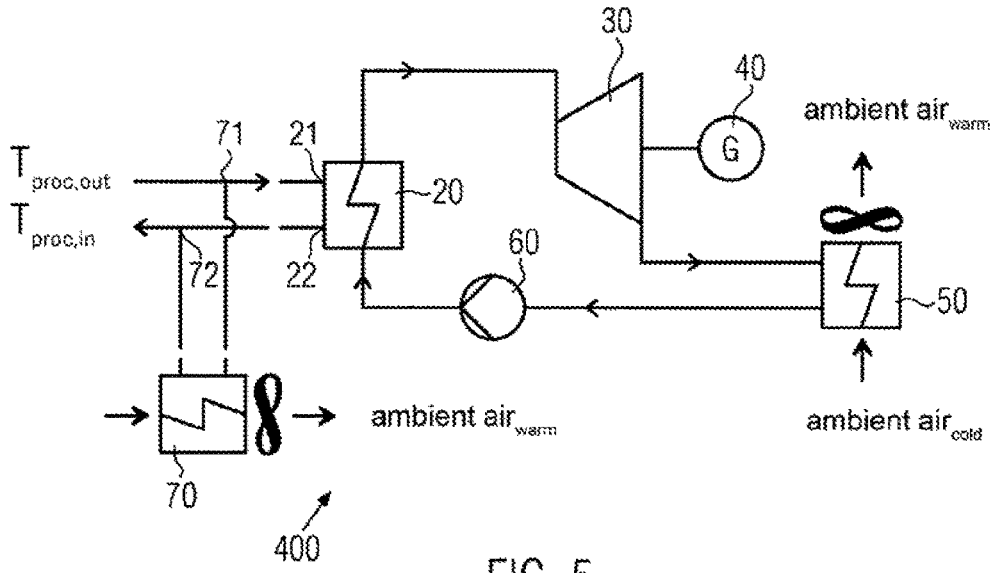
FIG. 5 shows a fourth embodiment (variant 2C) of the device according to the invention.

FIG. 5 shows a fourth embodiment 400 of the device according to the invention.

The fourth embodiment essentially corresponds to the second embodiment as shown in FIG. 2, the difference being that the cooler 70 is provided separately from the condenser 50.

The advantage of this variant is that the ORC cooler (with the components 20, 30, 40, 50, 60) and the air cooler (emergency cooler) 70 can be operated completely independently of each other and emergency cooling for the process is guaranteed even if the ORC cooler fails. In addition, the systemic separation of the ORC cooler and the air cooler facilitates easy integration into existing cooling systems. After integration, the existing cooler functions as an emergency cooler and the ORC cooler as an additional module ("backpack module") for retrofits or extensions.

Variant 3A—Parallel Interconnection in the Water Circuit

Figure 6:
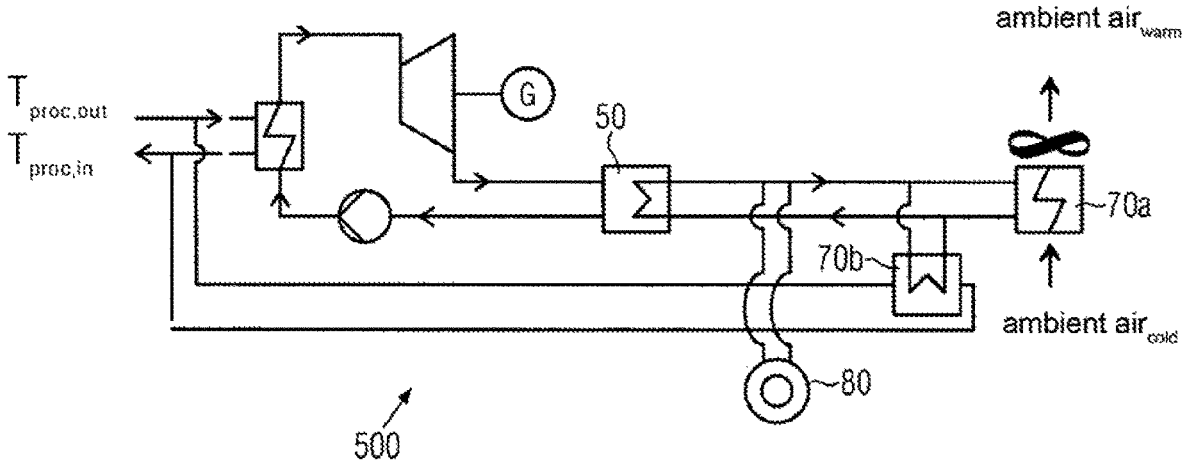
FIG. 6 shows a fifth embodiment (variant 3A) of the device according to the invention.

FIG. 6 shows a fifth embodiment 500 of the device according to the invention.

The fifth embodiment is essentially based on the second embodiment according to FIG. 2.

According to the fifth embodiment, the system 500 for thermal connection of the condenser 50 and the cooler 70*a*, 70*b*, however, further comprises an intermediate circuit with a heat transfer fluid (here water), wherein the condenser 50 is provided for transferring heat from the expanded working medium to the heat transfer fluid and wherein the cooler 70*a*, 70*b* is provided for cooling the heat transfer fluid. From a branch of the heat transfer fluid flowing from condenser 50 to cooler 70*a*, 70*b*, for example, useful heat can be discharged to a useful heat device 80.

Version 3B—Serial Interconnection in the Water Circuit

Figure 7:
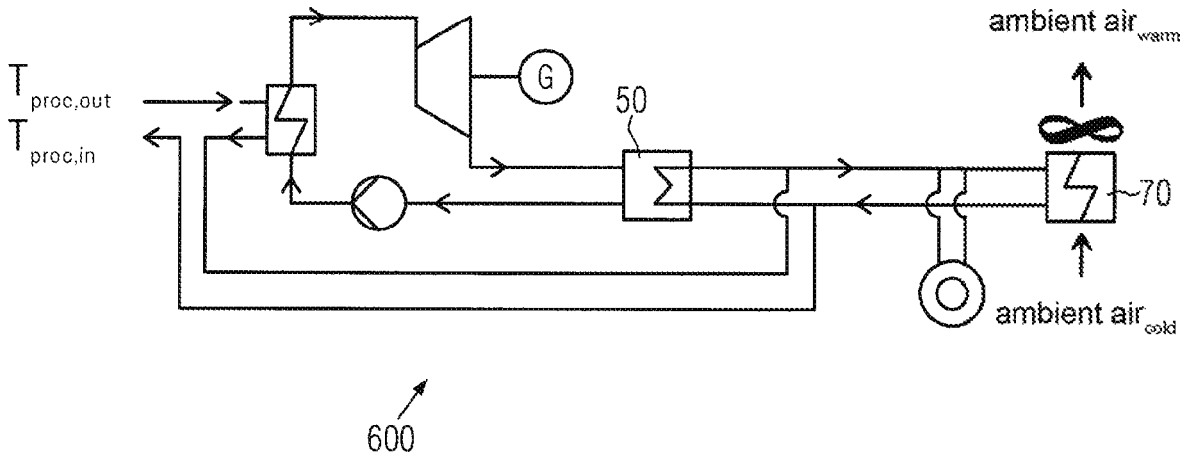
FIG. 7 shows a sixth embodiment (variant 3B) of the device according to the invention.

FIG. 7 shows a sixth embodiment 600 of the device according to the invention.

The sixth embodiment is based on the third embodiment as shown in FIG. 3 and has been modified analogous to the fifth embodiment. The (chemical) composition of the heat transfer fluid is identical to the composition of the process fluid.

It is often difficult to integrate air coolers (e.g. table coolers) into existing systems due to their large installation area. The interconnection variants 3A and 3B reduce this problem by inserting an additional heat exchanger 75 and a DC link with a heat transfer fluid (e.g. water) between ORC condenser 50 and cooler 70. Thus the installation locations of the heat source and the cooler are decoupled from each other and a great flexibility in the installation of the ORC process is achieved. Furthermore, the intermediate water circuit can supply other heat consumers. Variants 3A and 3B can also be permuted with regard to the heat source and heat sink.

Variant 4—Combination Cooler-Preheater-ORC

Figure 8:
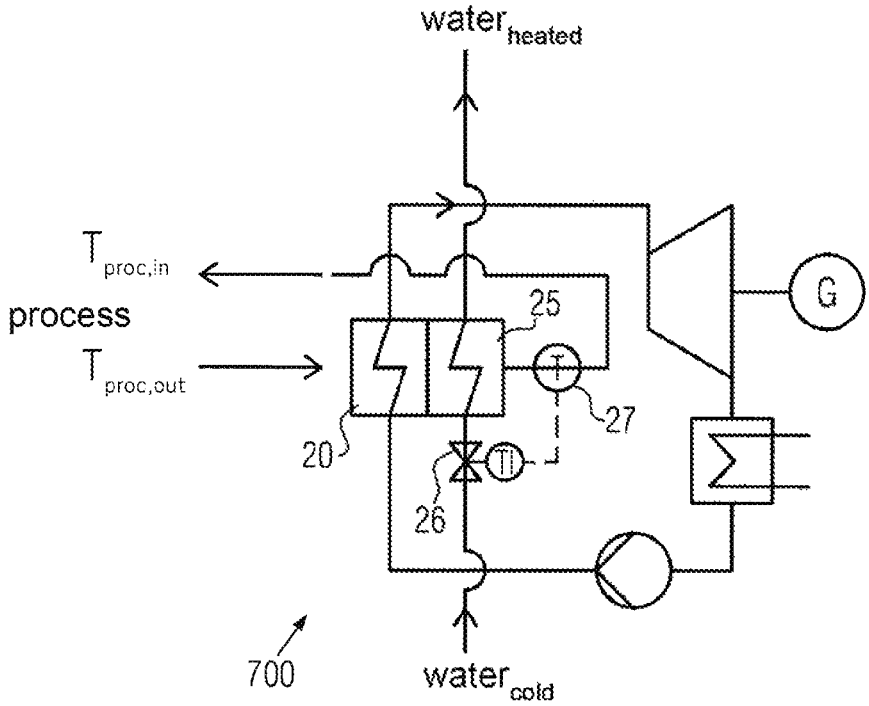
FIG. 8 shows a seventh embodiment (variant 4) of the device according to the invention.

FIG. 8 shows a seventh embodiment 700 of the device according to the invention.

According to the seventh embodiment 700 of the system according to the invention, a further heat exchanger 25 is provided which (with respect to a flow direction of the process fluid downstream of the evaporator 20) is provided for transferring heat from the process fluid cooled by the evaporator 20 to a heat transfer fluid.

The system comprises a valve 26 for controlling the mass flow of the heat transfer fluid through the further heat exchanger 25. Furthermore, and a temperature measuring device 27 for measuring the temperature of the process fluid downstream of the further heat exchanger 25 is provided, wherein the valve 26 is controlled depending on the measured temperature.

In this embodiment it is possible to achieve a reduction of the temperature $T_{proc,in}$ to the same temperature level as without ORC, by additionally using a partial flow of a cold process medium to be heated (heat transfer fluid, in this case water) for cooling. The heat is then removed in a first step by the ORC circuit. The pre-cooled heat-transferring process fluid then flows through the other heat exchanger 25 where it is cooled down to the target temperature.

To set the target temperature, another partial flow of the cold process medium to be heated can be added to the process fluid in the direction of flow after the other heat exchanger 25.

Variant 5—3-Stage Cooling of the Heat Supply Medium

Figure 9:
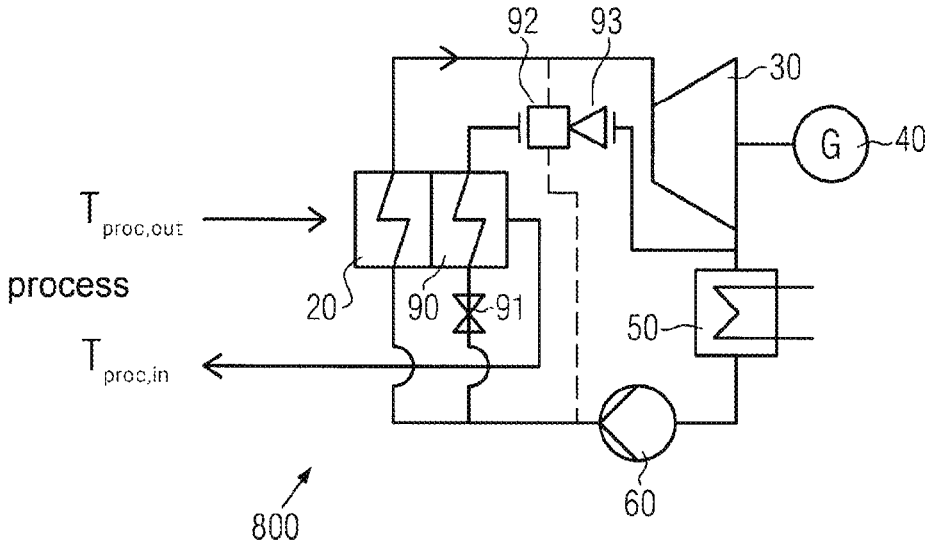
FIG. 9 shows an eighth embodiment (variant 5) of the device according to the invention.

FIG. 9 shows an eighth embodiment 800 of the device according to the invention.

According to the eighth embodiment, a further evaporator 90 is provided between the outlet 22 and the inlet 12 for further evaporation of working medium by means of heat from the process fluid. In addition, a throttle valve 91 for lowering the pressure of the working medium in the further evaporator 90 and a liquid jet pump 92 and/or a vapor jet pump 93 are arranged between the further evaporator 90 and the condenser 50 for lowering the pressure in the further evaporator 90, wherein in particular a part of the liquefied working medium or a part of the evaporated working medium serves as a driving jet. This is realized by a 3-stage cooling of the process fluid, as described below The drawing shows both the design with the liquid jet pump 92 and the steam jet pump 93. Usually only one of the two pumps is provided. With the liquid jet pump 92, the lower line after pump 60 is required for the liquid jet pump 92, while in the case of the vapor jet pump 93 the upper line is required for the working medium evaporated in the evaporator 20.

$1^{st}$ Stage: Normal Operation

After heat dissipation in the evaporator, the heat supply medium is returned to the process to be cooled.

$2^{nd}$ Stage: Cooling Operation

A partial flow of the working medium is fed to the evaporator 90 via the throttle valve (throttle) 91. The throttle 91 is adjusted so that the pressure is approximately equal to the pressure in the condenser 50. Due to the pressure reduction, the working medium in the evaporator 90 evaporates only minimally above the condensation pressure and the condensation temperature of the condenser 50, thus allowing the medium to be cooled down to a temperature similarly low as the minimum achievable temperature in a direct heat exchanger from the medium to be cooled to air. In this way, even if the cooling system is retrofitted with an ORC system, it is possible to ensure that the required temperatures of the medium to be cooled are maintained.

$3^{rd}$ Stage: Throttling to a Pressure Below the Condenser Pressure

A liquid jet pump 92 or a steam jet pump 93 causes the pressure in the evaporator 90 to be reduced to a pressure below the condensation pressure in the condenser 50, thus even a lower boiling pressure than the condensation pressure in the condenser 50 can be achieved. As a result, the working medium is conveyed with very little energy input and raised again to the condensation pressure. An advantage here is that the working medium only has to be pumped in low mass flows and with a small pressure increase. Here, either a part of the live steam or a part of the feed fluid serves as the driving jet.

Figure 10:
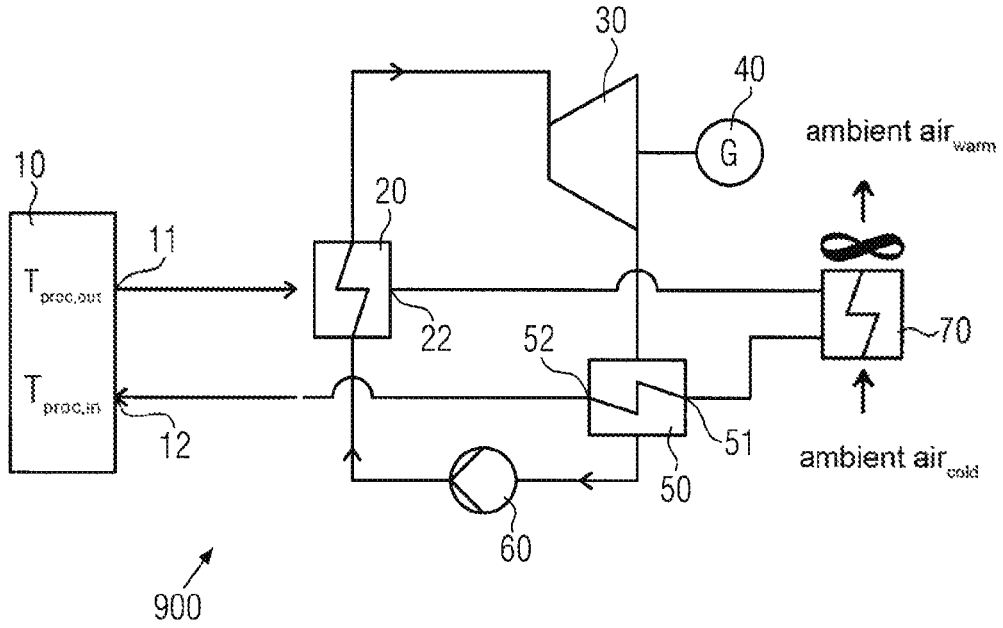
FIG. 10 shows a ninth embodiment (variant 6) of the device according to the invention.

Variant 6—Extension by an ORC Module for Existing Coolers/without Direct Condensation FIG. 10 shows a ninth embodiment 900 of the device according to the invention.

According to the tenth embodiment, the outlet 22 of the evaporator 20 is connected to the inlet 71 of the condenser 70, an outlet 72 of the condenser 70 is connected to the inlet 51 of the condenser 50 and an outlet 52 of the condenser 50 is connected to the inlet 12 of the heat-producing apparatus 10. During operation, the process fluid is guided from the evaporator 20 to the cooler 70 for further cooling, then through the condenser 50 as a heat-absorbing medium and again to the inlet 12 of the heat-producing apparatus 10.

This interconnection solves the problem of emergency operation, because the cooler 70 is operated independently of the ORC circuit. Depending on the desired target temperature, the ORC circuit extracts heat, the necessary cooling capacity is reduced and the downstream fan is relieved, which leads to a reduction in its maintenance intervals. This variant is characterized by its compactness (few components) and synergy effects of the common components. It can be used well for the integration of existing cooling systems. In addition to evaporation, condensation also takes place in the ORC circuit against the fluid to be cooled (in the other variants condensation takes place against the ambient air).

Figure 11:
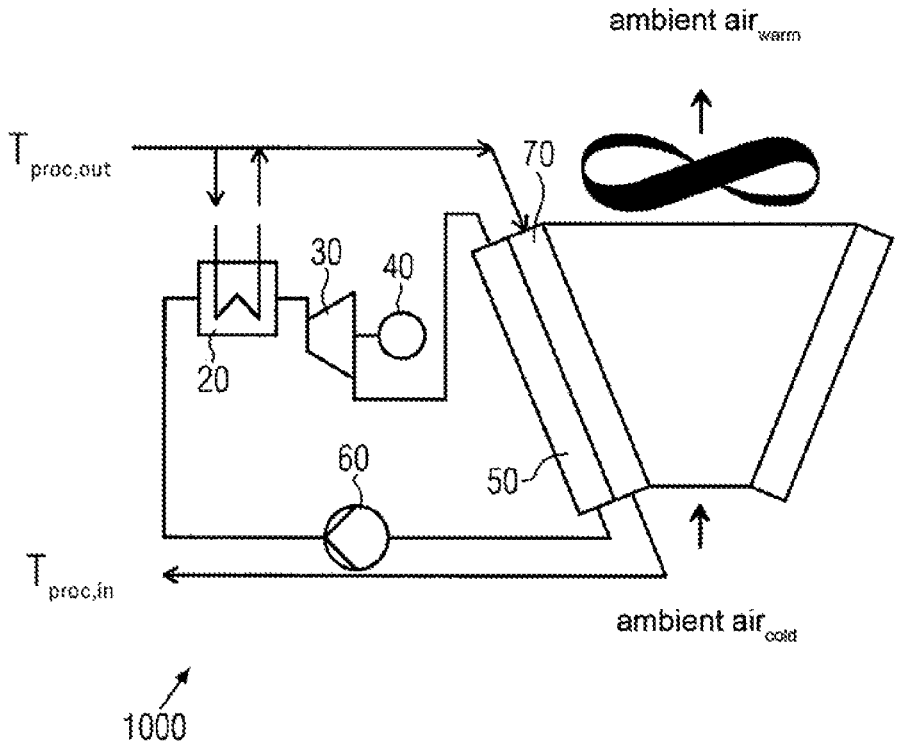
FIG. 11 shows a tenth embodiment (variant 7) of the device according to the invention.

Variant 7—Extension by an ORC Module for Existing Coolers/with Direct Condensation FIG. 11 shows a tenth embodiment 1000 of the device according to the invention.

This embodiment is similar to the ninth embodiment 900 as shown in FIG. 10, the difference being in capacitor 50 of the ORC circuit. In the variant 7 shown here, direct condensation takes place between ambient air and ORC working medium. Due to structural adjustments of the heat exchanger surfaces, the expansion of standard models in industry is possible with little effort. The measure differs depending on the cooler model.

All variants can be combined with each other as desired.

Advantages/Disadvantages of the System According to the Invention:

Advantages can be mentioned as follows: Increase of operational safety (2 independent cooling systems, ORC+cooler); use of as many synergy components of cooler and ORC as possible; low maintenance; very good economy (saving of electrical energy); reduction of $CO_2$-emission; increase of efficiency (efficiency of the cooling process is increased, synergy effects between components). In addition, an existing cooler can be used to cool the ORC condenser and with little design effort, a process that requires energy can be turned into an energy neutral or energy generating process.

The disadvantage is that the addition of additional components increases the complexity of the overall system (e.g.: coordination of controls, additional costs, additional interfaces, . . . ).

The embodiments presented are only exemplary and the complete scope of the present invention is defined by the claims.

The invention claimed is:

1. A system for cooling a process fluid of a heat-producing apparatus, comprising:

an outlet of the heat-producing apparatus, the outlet being provided for discharging process fluid to be cooled from the heat-producing apparatus;

an inlet of the heat-producing apparatus, the inlet being provided for supplying cooled process fluid to the heat-producing apparatus; and a thermodynamic cycle device comprising:

an evaporator having an inlet for supplying the process fluid to be cooled from the outlet of the heat-producing apparatus and having an outlet for discharging the cooled process fluid to the inlet of the heat-producing apparatus, wherein the evaporator is adapted to evaporate a working medium of the thermodynamic cycle device by means of heat from the process fluid;

an expansion machine for expanding the evaporated working medium and for generating at least one selected from the group consisting of mechanical and electrical energy;

a condenser for liquefying the expanded working medium, wherein the condenser comprises an air-cooled condenser;

a pump for pumping the liquefied working medium to the evaporator;

wherein the at least one selected from the group consisting of mechanical and electrical energy generated by the expansion machine is used to drive a fan of the air-cooled condenser; and further comprising a cooler comprising an air cooler for cooling at least part of the process fluid to be cooled, wherein the cooler forms a structural unit with the air-cooled condenser and the fan is common to both the air-cooled condenser and the air cooler.

2. The system according to claim 1, further comprising:

a branch provided downstream of the outlet of the heat-producing apparatus and upstream of the inlet of the heat-producing apparatus with respect to a flow direction of the process fluid for dividing the process fluid to be cooled into a first and a second partial flow of the process fluid, the branch comprising a valve; and a junction provided downstream of the branch with respect to a flow direction of the process fluid and upstream of the inlet of the heat-producing apparatus for merging the first and second partial flows of the process fluid.

3. The system according to claim 2, wherein the branch is adapted to supply the first partial flow to the evaporator and to supply the second partial flow to the cooler, and wherein the junction is adapted to merge the second partial flow of the process fluid cooled by the cooler and the first partial flow of the process fluid cooled by the evaporator.

4. The system according to claim 2, further comprising:

a cooler comprising an air cooler for cooling at least part of the process fluid to be cooled, wherein the junction is adapted to merge the first partial flow of the process fluid cooled by the evaporator and the second partial flow of the process fluid; and wherein the junction is adapted to supply the joined partial flows of the process fluid to the cooler.

5. The system according to claim 1, wherein the cooler is arranged downstream of the outlet of the evaporator with respect to a flow direction of the process fluid and upstream of the inlet of the heat-producing apparatus for further cooling the process fluid cooled by the evaporator.

6. The system according to claim 1, further comprising a control device for controlling the heat input into the cooler, wherein a set temperature of the process fluid returned to the inlet of the heat-producing apparatus can be achieved.

7. The system according to claim 1, wherein an intermediate circuit with a heat transfer fluid is provided for thermal connection of the condenser and the cooler, wherein the condenser is provided for transferring heat from the expanded working medium to the heat transfer fluid, and wherein the cooler is provided for cooling the heat transfer fluid.

8. The system according to claim 7, wherein useful heat is removed from a branch of the heat transfer fluid flowing from the condenser to the cooler to a useful heat device.

9. The system according to claim 7, wherein a composition of the heat transfer fluid is identical to a composition of the process fluid.

10. The system according to claim 1, further comprising:

a second heat exchanger provided downstream of the evaporator with respect to a flow direction of the process fluid for transferring heat from the process fluid cooled by the evaporator to a heat transfer fluid.

11. The system according to claim 10, further comprising:

a valve for controlling the mass flow of the heat transfer fluid through the second heat exchanger;

wherein a temperature measurement device is provided for measuring the temperature of the process fluid downstream of the second heat exchanger, wherein the control of the valve is effected depending on the measured temperature.

12. The system according to claim 1, further comprising:

a second evaporator between the outlet of the evaporator and the inlet of the heat-producing apparatus for further evaporation of working fluid using heat from the process fluid;

a throttle valve for adjusting the size of a partial flow of the working medium through the further evaporator; and a liquid jet pump or a vapor jet pump between the second evaporator and the condenser for lowering the pressure in the second evaporator, wherein a part of the liquefied working medium or a part of the evaporated working medium serves as a driving jet.

13. A system according to claim 1, wherein the outlet of the evaporator is connected to an inlet of the cooler, an outlet of the cooler is connected to an inlet of the condenser, and an outlet of the condenser is connected to the inlet of the heat-producing apparatus, so that in operation the process fluid is guided from the evaporator through the cooler for further cooling, is subsequently passed through the condenser as a heat-absorbing medium, and is in turn subsequently guided to the inlet of the heat-producing apparatus.

14. The system according to claim 1, further comprising:

a branch provided downstream of the outlet of the heat-producing apparatus and upstream of the inlet of the heat-producing apparatus with respect to a flow direction of the process fluid for dividing the process fluid to be cooled into a first and a second partial flow of the process fluid, the branch comprising a valve; and a junction provided downstream of the branch with respect to a flow direction of the process fluid and upstream of the inlet of the heat-producing apparatus for merging the first and second partial flows of the process fluid.

15. The system according to claim 14, wherein the branch is adapted to supply the first partial flow to the evaporator and to supply the second partial flow to the cooler, and wherein the junction is adapted to merge the second partial flow of the process fluid cooled by the cooler and the first partial flow of the process fluid cooled by the evaporator.

16. The system according to claim 14, wherein the junction is adapted to merge the first partial flow of the process fluid cooled by the evaporator and the second partial flow of the process fluid; and wherein the junction is adapted to supply the joined partial flows of the process fluid to the cooler.

17. The system according to claim 14, wherein an intermediate circuit with a heat transfer fluid is provided for thermal connection of the condenser and the cooler, wherein the condenser is provided for transferring heat from the expanded working medium to the heat transfer fluid, and wherein the cooler is provided for cooling the heat transfer fluid.

* * * * *